US005885375A

United States Patent [19]

Takemura et al.

[11] Patent Number: 5,885,375

[45] Date of Patent: Mar. 23, 1999

[54] HIGH STRENGTH TITANIUM ALLOY, PRODUCT MADE OF THE TITANIUM ALLOY AND METHOD FOR PRODUCING THE PRODUCT

[75] Inventors: Atsushi Takemura, Chiyoda-ku; Hachiro Kushida, Tanashi; Norio Hashimoto, Tanashi; Tadao Enomoto, Tanashi; Hideo Taguchi, Tanashi, all of Japan

[73] Assignees: Kabushiki Kaisha Kobe Seiko Sho, Kobe; Citizen Watch Co., Ltd., Tokyo, both of Japan

[21] Appl. No.: 952,511

[22] PCT Filed: Mar. 26, 1997

[86] PCT No.: PCT/JP97/01023

§ 371 Date: Nov. 28, 1997

§ 102(e) Date: Nov. 28, 1997

[87] PCT Pub. No.: WO97/37049

PCT Pub. Date: Oct. 9, 1997

[30] Foreign Application Priority Data

| | | | |
|---|---|---|---|
| Mar. 29, 1996 | [JP] | Japan | 8-077596 |
| Mar. 29, 1996 | [JP] | Japan | 8-077597 |
| Mar. 25, 1997 | [JP] | Japan | 9-072369 |
| Mar. 25, 1997 | [JP] | Japan | 9-072370 |

[51] Int. Cl.[6] ..... C22C 14/00

[52] U.S. Cl. ..... 148/421; 148/671; 420/417

[58] Field of Search ..... 420/417, 418, 420/419, 420, 421; 148/421, 669, 670, 671

[56] References Cited

U.S. PATENT DOCUMENTS

| | | | |
|---|---|---|---|
| 4,857,269 | 8/1989 | Wang et al. | 420/417 |
| 4,886,559 | 12/1989 | Shindo et al. | 148/421 |
| 5,141,566 | 8/1992 | Kitayama et al. | 148/670 |
| 5,759,484 | 6/1998 | Kashii et al. | 420/420 |

FOREIGN PATENT DOCUMENTS

| | | |
|---|---|---|
| 55-34856 | 9/1980 | Japan . |
| 5-72452 | 10/1993 | Japan . |

*Primary Examiner*—John Sheehan
*Attorney, Agent, or Firm*—Oblon, Spivak, McClelland, Maier & Neustadt, P.C.

[57] ABSTRACT

The present invention provides a high strength titanium alloy useful as a material for products such as ornaments, products such as ornaments made of the titanium alloy, and a method for producing the products using the titanium alloy as a material. The high strength titanium alloy is capable of attaining high machinability, and the product made of the titanium alloy is excellent in beauty and decorativeness while being hard to made flawed or concaved. According to the present invention, the titanium alloy includes iron of 0.20 to 0.8 mass percent and oxygen of 0.20 to 0.6 mass percent, or iron of 0.2 to 1.0 mass percent, oxygen of 0.15 to 0.6 mass percent and silicon of 0.20 to 1.0 mass percent, with the balance of titanium and inevitable impurities. A method for producing a product using the titanium alloy as a material includes a steps of hot forging the titanium alloy at a temperature of (β-transformation temperature −200° C.) or higher, and then cooling it, thereby giving a high strength to the product.

16 Claims, No Drawings

HIGH STRENGTH TITANIUM ALLOY, PRODUCT MADE OF THE TITANIUM ALLOY AND METHOD FOR PRODUCING THE PRODUCT

TECHNICAL FIELD

The present invention relates to a high strength titanium alloy useful as a material for products such as ornaments including watch bodies, watch bands, bracelets, earrings, pendants, necklaces, eyeglass frames; the products made of the titanium alloy; and a method for producing the products.

BACKGROUND ART

Titanium has excellent corrosion resistance and high ratio of strength/specific gravity with no change in color and the like with the elapse of time. Therefore, titanium is expected to be useful as a material for products such as ornaments which a person puts on the body. Especially, in recent years, ornaments are required to be made of biocompatible material which does not cause metal allergy for human body. As titanium is a typical material which does not cause metal allergy, much attention has been focused on titanium as a material for ornaments. Under such circumstances, titanium has been superseding conventional metals such as stainless steel as a material for ornaments.

Ornaments are required to satisfy the requirements such as beauty in appearance, ability of being formed in a complicated and precise shape, and high resistance to getting flawed during the use in daily life. In addition, ornaments are required to have a clear mirror-finished surface which is capable of being formed with various kinds of surface finishings (such as letters written in extremely thin thickness to the extent of hair: hereinafter, referred to as hair-line property). From the viewpoint of machinability, ornaments are required to be produced with a number of minute holes satisfactorily formed therein.

In reality, titanium and titanium alloys used as a material for ornaments, and a method for producing ornaments are derived from the technologies developed in other industrial fields such as aerospace field, chemical industries, and nuclear energy field. Thus-produced ornaments do not necessarily satisfy the required properties.

Industrial pure titanium of JIS-1 series or JIS-2 series is one of the materials which are most commonly used for ornaments. However, the ornaments made of such titanium are easy to get flawed by contact or friction in a daily life, or their surface finishes are worn out. Therefore, the ornaments made of such titanium are inferior to those made of stainless steel in beauty and decorativeness, which are essential properties for ornaments.

As an titanium alloy includes large amount of alloy elements, ornaments made of titanium alloy have increased strength and high resistance to flaw. In this respect, an titanium alloy is superior to industrial pure titanium as a material for ornaments. However, as an titanium alloy is poor in processability, it is difficult to conduct a precise and minute machining thereto, resulting in imposing limitations on designs of ornaments. In addition, almost all titanium alloys include alloy elements such as aluminum, nickel, vanadium, chromium. These alloy elements are poor in biocompatibility, and therefore, not desirable for ornaments. In addition, as these alloy elements are relatively expensive, the material cost becomes high.

Various technologies have been developed for improving the abrasion resistance of industrial pure titanium and the machinability of titanium alloy. However, these technologies are intended for use in the fields other than ornament industries, and therefore, are not applicable to ornaments. For example, Japanese Patent publication No. 7-62196 suggests a titanium alloy having an improved abrasion resistance. In this art, the abrasion resistance of the titanium alloy is improved by dispersing titanium carbide. However, the obtained titanium alloy has too high hardness, resulting in shortening a life of drill which is used in a drilling process of forming minute holes for ornaments. Japanese Patent publication No. 5-42490 suggests a titanium alloy in which inclusions such as sulfide are dispersed for the purpose of enhancing the machinability and free-cutting properties thereof. However, the inclusions are too soft to give the produced ornaments an enhanced resistance to flaw. Rather, the presence of such inclusions large in size may be a hindrance to give a mirror-finished surface to ornaments.

On the other hand, conventional methods do not necessarily contribute to the improvement of the properties of ornaments. For example, Japanese Laid-Open patent publication No. 3-180478 suggests technology where a surface of pure titanium material is coated with a hard coating, thereby enhancing its resistance to flaw. However, the surface treatment of this technology has a problem that the coated surface loses metallic luster or turns into darker color, resulting in the deterioration of beauty. In addition, as titanium used as a parent material itself is easy to get flawed, the titanium material may be flawed during the processes conducted prior to a surface treatment. The resultant ornaments having flaws are of no commercial value.

In order to enhance the strength of products, there is a known method in which a thermal treatment is conducted. When the thermal treatment is conducted, however, the product gains high hardness not only on the surface thereof but also at the inside thereof. As a result, the whole product gains high hardness and satisfactory machining cannot be conducted thereto. In addition, the thermal treatment has a hardness-increasing effect only on a $\beta$-type titanium alloy or an $\alpha+\beta$-type titanium alloy which contain large amount of alloy elements. Although a cold working such as a cold forging induces a work hardening thereby attaining the increase in hardness, a cold forging increases the hardness of the whole product and the machinability remains unimproved. In contrast, a method such as shot peening is capable of increasing the hardness of the product on only the surface thereof by forming a strained region only on the surface. However, she shot peening is not applicable to the production of products required to be formed in a refined shape.

In the actual state, in the production of ornaments made of pure titanium, industrial pure titanium material having low resistance to flaw is used without being subjected to any treatment, or is surface treated at the sacrifice of decorativeness. There are some cases where a Ti-3Al-2.5V type titanium alloy is used as a material for ornaments. The Ti-3Al-2.5V type titanium alloy has an intermediate characteristics between industrial pure titanium and the above-described titanium alloy. However, the Ti-3Al-2.5V type titanium alloy does not satisfy the requirement of the resistance to flaw, processability, and cost performance, and contains unbiocompatible elements such as aluminum and vanadium. Due to such disadvantages, the Ti-3Al-2.5V type titanium alloy can be used only a limited application.

As described above, the conventional titanium, titanium alloys, and method for producing ornaments using these materials are not suitable for ornaments. Under such circumstances, there is a great demand for developing titanium material and a method for producing products using the titanium material capable of attaining excellent properties such as decorativeness, durability, processability, biocompatibility with low cost, thereby coming such material and method into wide applications including not only ornaments but also decorations and articles of daily use.

The present invention has been conducted to solve the above-described problems, and the objective thereof is to provide: a high strength titanium alloy capable of attaining beauty and decorativeness and especially useful as a material for ornaments; products made of such titanium alloy; and a method for producing the products.

DISCLOSURE OF THE INVENTION

To solve the above problems, this invention has adopted the following arrangement.

The present invention is directed to a high strength titanium alloy comprising iron of 0.20 to 0.8 mass percent, oxygen of 0.20 to 0.6 mass percent, with the balance comprising titanium and inevitable impurities. Preferably, the titanium alloy contains iron of 0.3 to 0.5 mass percent and oxygen of 0.3 to 0.5 mass percent. The proportion of the contents of iron and oxygen in the titanium alloy is determined in accordance with the required properties.

A high strength titanium alloy may comprise iron of 0.2 to 1.0 mass percent, oxygen of 0.15 to 0.6 mass percent, and silicon of 0.20 to 1.0 mass percent, with the balance of titanium and inevitable impurities. In this case, preferably, the titanium alloy contains iron of 0.3 to 0.7 mass percent, oxygen of 0.20 to 0.40 mass percent, and silicon of 0.40 to 0.80 mass percent. The proportion of the contents of iron, oxygen, and silicon in the titanium alloy is determined in accordance with the required properties.

The titanium alloy is useful as a material for products for which high strength is required, and can provide excellent processability. Therefore, the titanium alloy is especially effective when used as a material for ornaments such as watch bodies, watch belts, bracelets, earrings, pendants, necklaces, and eyeglass frames. Preferably, a product made of the titanium alloy has Hv20 or more on its surface larger than at its inside.

The product made of high strength titanium is produced by a method including the steps of hot forging the high strength alloy at a temperature of (β-transformation temperature −200° C.) or higher, and cooling the hot forged titanium alloy. In order that the titanium alloy product has Hv20 or more on its surface larger than at its inside, the method preferably comprises the step of hot forging a high strength titanium alloy at a temperature of (β-transformation temperature −200° C.) and at a strain rate of $10^{-1}$/second or higher, where at least one of the following conditions (a) and (b) is satisfied:

(a) the hot forging is performed using a mold having a temperature of 500° C. or lower, and then, the hot forged titanium alloy is cooled; and (b) the hot forged titanium alloy is cooled to 500° C. or lower at a cooling rate of $10^2$ °C./min or higher within 10 seconds after the hot forging.

It is required that the titanium alloy is hot forged at the temperature of (β-transformation temperature −200° C.) or higher, and the preferable maximum temperature of hot forging is 950° C.

BEST MODE FOR CARRYING OUT THE INVENTION

The present inventors have conducted various studies on the causes of flaw generation, especially on the visible flaws formed on the surface of ornaments which deteriorate the beauty thereof. When an ornament is rubbed with something by accident in daily life, its surface may get flawed. The flaws may consist of major ones and minor ones. As a result of studies, it has been found that both of these flaws are visually recognized as a plastic deformation.

As a result of detailed examination on the relationship between a size of flaws and the causes of flaw generation, it has been found that the width and depth of flaws are dependent on the hardness and the grain diameter of the crystal grains contained in the main phase of the material. In other words, the depth and width of the flaws are suppressed to smaller as the crystal grains contained in the main phase has higher hardness and smaller grain diameter. The reason thereof is as follows. As to the hardness, the plastic deformation of crystal grains is reduced to smaller level as the hardness thereof is increased. With higher hardness, the crystal grains undergo only small deformation during a plastic deformation process such as an indentation process. As to the grain diameter, when a part of crystal grains gets flawed, a plastic deformation (such as a slip deformation and a twin deformation) occurs at the flawed crystal grain portion, and the plastic deformation is likely to expand therefrom to the entire crystal grains. In this case, if the grain diameter of the crystal grains is small, the plastic deformation expands only in a small region. Consequently, flaws are suppressed to small region. Preferable grain diameter is 10 μm or less.

Based on the above studies, the present inventors have studied on the methods for reinforcing an α-phase, which is a stable phase at a room temperature, as a main phase of a material for ornaments. A β-phase is not preferable as a main phase for the following reason. If a β-phase is present as a main phase in the material at a room temperature, it is required to add large amount of β-stabilized elements. The material containing large amount of β-stabilized elements has too high hardness and tackiness, and therefore, is hard to be processed. In addition, such a material is expensive. In this case, however, if the α-phase is excessively solid-solution hardened, the material obtains too high hardness. As a result, the machineability of the material is deteriorated where, for example, the lifetime of a drill which is used for forming minute holes having a diameter of 1mm or less in the production of ornaments such as watches, is shortened. Contrary to this, if the strength of the material is increased by precipitation hardening or dispersion hardening of the α-phase, the material is not excessively hardened, and therefore, the lifetime of drill is not seriously shortened in a machining process. However, there is a limit in increasing a strength of the material by only the precipitation hardening of the α-phase.

To solve such a problem, the present inventors have reached a method where an increase in strength of titanium alloy is attained by adding a minimum amount of an α-stabilized element which is to be present in a form of solid-solution, and further increase in strength thereof is attained by adding other elements which are to be present in a form of precipitation. In this method, it is expected that the growth of the crystal grains in the form of precipitation in the α-phase is suppressed to small, whereby the crystal grains have only a small diameter. The elements used in this method satisfy the required conditions as to attain large effect with small added amount, to assure high safety for human body, and to require low cost.

As a result of the studies, it has been revealed that oxygen is the optimal element as an α-stabilized element. Oxygen has high ability of increasing the strength of titanium alloy and is available at low cost in a form of titanium oxide, with less fear of segregation. Whereas nitrogen is expected to have an effect similar to that of oxygen, it easily segregates and requires high cost. Zirconium has problems in its poor ability of solid-solution strengthening with extremely high cost. The present inventors also tentatively added carbon as an α-stabilized element; however, carbon was not suitable for the following reason. The addition of carbon into titanium produces titanium carbide. The titanium carbide has Hv1000 or higher and therefore, remarkably shortens the lifetime of a drill with a small diameter used in a machining process. In some cases, sulfur is added to titanium to produce sulfide, because sulfur has an effect of improving free-cutting properties. However, sulfide is too soft to improve the resistance to flaw.

Contrary to this, when oxygen is added to titanium, the resultant titanium alloy has an improved resistance to flaw. With oxygen content of 0.20 mass percent or more, the resultant titanium alloy has superior resistance to flaw as compared with the conventional Ti-3Al-2.5V type alloy. However, with only oxygen in the content of 0.20 mass percent or more, the titanium alloy is inferior to the conventional Ti-3Al-2.5 type alloy in the drilling properties. This shows the fact that the addition of oxygen only is not enough to produce a titanium alloy superior to the conventional Ti-3Al-2.5V type alloy in both the resistance to flaw and the processability.

On the other hand, the present inventors have selected iron as a most optimal precipitation hardening element. Iron is present in a form of solid-solution in the α-phase in a small amount, and also has an ability to form a β-phase dispersed in the α-phase. Iron has high ability of improving the strength of the titanium alloy. In addition, iron is biocompatible with low cost. It was anticipated that nickel, chromium, and copper had the same effect as that of iron; however, they were inferior to iron in the ability of improving the strength of titanium alloy and biocompatibility.

The present inventors have further studied on the optimal precipitation hardening elements, and have found that the combination of iron and silicon is most effective in precipitation strengthening. Silicon easily reacts with titanium to form a titanium compound (silicide), and is present in a form of a solid solution in the α-phase only in a small amount. The addition of silicon has a further effect in suppressing the grain diameter to small in the α-phase. Silicon is excellent in biocompatibility, and is available at low cost in a form of, for example, ferrosilicon (i.e., a compound of iron and silicon).

When oxygen, iron, and silicon are simultaneously added to titanium, the resultant titanium alloy is in a state where the β-phase is dispersed in the α-phase in a fine form, thereby having higher strength than the Fe—O type alloy. As compared with iron-oxygen type alloy, the titanium alloy has a superior balance between strength and free-cutting properties.

It has been considered to add silicon in stead of iron (to produce a silicon-oxygen type titanium alloy). However, the combination of silicon and oxygen produces a silicon oxide which disperses in a too fine form in the α-phase. This results in the decrease in ductility and the increase in resistance to high-temperature deformation. From this result, the combination of silicon and oxygen cannot be employed.

The titanium alloy of the present invention is produced by simultaneously adding oxygen and iron, or oxygen, iron, and silicon. Thus-obtained titanium alloy has improved resistance to flaw and drilling properties. That is, the titanium alloy of the present invention includes iron of 0.20 to 0.8 mass percent and oxygen of 0.20 to 0.6 mass percent, or iron of 0.2 to 1.0 mass percent, oxygen of 0.15 to 0.60 mass percent, and silicon of 0.20 to 1.0 mass percent, with the balance including titanium and inevitable impurities. The titanium alloy having such a chemical composition has a superior resistance to flaw and processability as compared with the conventional Ti-3Al-2.5V type alloy. The titanium alloy of the present invention has a reduced resistance to hot deformation due to the presence of β-phase.

In the present invention, reasons for restricting the chemical components in the titanium alloy are as follows.

Iron: 0.20 to 0.8 mass percent or 0.2 to 1.0 mass percent

When the content of iron is less than 0.20 mass percent (or 0.2 mass percent when silicon is contained), the resistance to flaw and machinability are not sufficiently improved. When the content of iron is exceeding 0.8 mass percent (or 1.0 mass percent when silicon is contained), the effects of improving the resistance to flaw and machinability are only saturated. Rather, the excessive content of iron impairs the corrosion resistance of the titanium alloy. With the impaired corrosion resistance, a problem arose that the titanium alloy, used as a material for ornament to which a surface treatment such as gold-plating is performed, was corroded by a plating treatment liquid (a plating solution). When the content of iron is less than 0.20 mass percent (or 0.2 mass percent when silicon is contained), the titanium alloy has too large resistance to deformation in hot working which renders it impossible to perform a precise molding. Preferable content of iron is 0.3 to 0.5 mass percent (or 0.3 to 0.7 mass percent when silicon is contained), where the addition of iron provides maximum effect. When iron is added together with silicon, iron is stabilized in the presence of silicon. This is because silicon is hard to diffuse as compared with iron and is thermally stable. In addition, silicon has an effect of giving an improved corrosion resistance to titanium alloy. Therefore, when added with silicon, larger amount of iron can be added (i.e., the maximum content of iron is increased from 0.8 mass percent to 1.0 mass percent) than the case where iron is added alone without adding silicon.

Oxygen: 0.20 to 0.6 mass percent or 0.15 to 0.60 mass percent

When the content of oxygen is less than 0.20 mass percent (or 0.15 mass percent when silicon is contained), the resistance to flaw is poor. When the content of oxygen is exceeding 0.6 mass percent (or 0.60 mass percent when silicon is contained), the processability of the alloy falls short of the target value. When the content of oxygen is 0.20 mass percent (or 0.15 mass percent when silicon is contained), the hardness of the surface of titanium alloy is not increased to a sufficient value. Preferable content of oxygen is 0.3 to 0.5 mass percent (or 0.20 to 0.40 mass percent when silicon is contained), where the addition of oxygen displays the maximum effect. When oxygen is added together with silicon, the β-phase are formed in a finely dispersed form in the α-phase thereby giving high strength to the titanium alloy. As a result, the titanium alloy has high resistance to flaw. Thus-attained resistance to flaw is in a good balance with the processability. When added together with silicon, even less amount of oxygen (i.e., the content of 0.15 mass percent) displays the maximum effect.

Silicon: 0.20 to 1.0 mas percent

When the content of silicon is less than 0.20 mass percent, the resistance to flaw and machinability are not sufficiently improved. The addition of silicon exceeding 1.0 mass percent saturates these effects, and rather, deteriorates the hot working properties, causing cracking of the titanium alloy material when forged. Preferable content of silicon is 0.40 to 0.80 mass percent, where the addition of silicon displays the maximum effect.

In the present invention, the method for producing ornaments made of titanium alloy includes a step of hot forging a titanium alloy at a temperature of (β-transformation temperature −200° C.) or higher, and a step of cooling the hot forged titanium alloy. The present inventors have made studies on a method for producing an ornament having a hardness higher at its surface than at its inside without deteriorating its beauty and decorativeness. More specifically, the present inventors have studied the required conditions of producing an ornament having a hardness higher at its surface than at its inside by thermo-mechanical treatment, thereby increasing the resistance to flaw while maintaining the processability such as drill machinability. As a result of the detailed studies on the influence of thermo-mechanical treatment to the surface hardness, it has been found that it is possible to keep the surface of ornament in a work hardened state when the strain rate is sufficiently high and a cooling is performed before the strain, produced in hot forging, recovers. For example, when a hot working is performed using a mold having a temperature lower than the recovery temperature, the surface of material is cooled at the same time as the material is deformed. In this manner, the surface of the material is cooled to a temperature lower than the recovery temperature, whereby only the surface is kept in a hot hardened state. Or alternatively, it is also possible to increase in the hardness of the surface only when the material can be sufficiently cooled before the material is recovered to a completely softened state, even if the hot working is performed using a mold having a high temperature and the material is not cooled during the hot working.

Based on the above considerations, the present inventors have found a method for producing an ornament having a hardness higher on its surface than at its inside by hot working only. The method includes a step of hot forging a titanium alloy material at the temperature of (β-transformation temperature −200° C.) or higher and at a strain rate of $10^{-1}$/second or higher, where at least one of the following conditions (a) and (b) is satisfied:

(a) the hot forging is performed using a mold having a temperature of 500° C. or lower, and then, the hot forged titanium alloy is cooled; and (b) the hot forged titanium alloy is cooled to 500° C. or lower at a cooling rate of $10^2$ °C./min or higher within 10 seconds after the hot forging.

The β-transformation temperature indicates a temperature at which an α-phase is transformed to a β-phase or α+β-phase is transformed to a β-phase. The titanium alloy is required to be hot forged at a temperature of (β-transformation temperature −200° C.) and the maximum temperature of the hot forging is 950° C. When the titanium alloy is hot forged at a temperature higher than 950° C., an oxidized layer having a large thickness is formed on the surface of the titanium alloy. It takes long time for polishing the surface formed with an oxidized layer having a large thickness. There are some cases where an ornament having a small mass may be cooled at a cooling rate of $10^2$ °C./min or higher by just being left without being subjected to any cooling process. Therefore the "cooling" includes the case where the titanium alloy is just left without being subjected to any cooling process after the hot forging.

When a mold having a temperature of 500° C. or higher is used, the titanium alloy is hot forged at a strain rate of $10^{-1}$/second or higher. Then, the hot forged titanium alloy is cooled to 500° C. or lower at a cooling rate of $10^2$ °C./min or higher within 10 seconds after the hot forging. In this case, it is possible to increase the hardness of the surface to the value larger than at the inside, whereas the difference in hardness between the surface and inside is not sufficiently large. The effect of the present invention can be attained when at least of the above-described conditions (a) and (b) is satisfied; however, further effect can be attained if both the conditions (a) and (b) are satisfied. By satisfying at least one of the conditions (a) and (b), the hardness of has Hv20 or higher at its surface larger than at its inside.

The conditions (a) and (b) are determined due to the following reason.

When a titanium alloy is hot forged at a temperature less than (β-transformation temperature −200° C.), the deformability of the titanium alloy is deteriorated, which may cause its surface to crack during the hot forging. Even if the hot forging is performed using a mold having a temperature of 500° C. or higher contrary to the condition (a), it is possible to produce an ornament having Hv20 or higher at its surface larger than at its inside by satisfying the condition (b). When the hot forging is performed using a mold having a temperature of 500° C. or less, a produced ornament has a hardness higher at its surface than at is inside, regardless of whether or not the condition (b) is satisfied. When the hot forging is performed at a strain rate of $10^{-1}$/second or higher, the produced ornament has a hardness higher than at its surface than at its inside. Contrary to this, when the hot forging is performed at a strain rate of less than $10^{-1}$/second, the produced ornament has a same hardness at its surface and at its inside. From this result, it is supposed that when the hot forging is performed for a short period of time at a strain rate of $10^{-1}$/second or higher, the strength attained in the hot forging is never lost by a recovery phenomenon.

When the cooling is started more than 10 seconds later after the hot forging, the produced ornament has the same hardness at its surface as at its inside. Contrary to this, when the cooling is started within 10 seconds after the hot forging at a cooling rate of $10^2$/min or higher to cool a titanium alloy to a temperature of 500° C. or lower, the produced ornament has a hardness higher at its surface than at its inside.

The effect of the present invention can be attained as far as the hot forging, which is the last step of producing an ornament, is performed under the above-described conditions. Prior to performing the hot forging, a preliminary hot working may be performed (for example, hot rolling, hot forging and the like). After the hot forging, subsequent processes are performed, including a first machining process such as free-cutting and drilling, and a second machining process such as finishing process such as polishing. Consequently, a final ornament is obtained.

Hereinafter, the present invention will be described in more detail with reference to examples. However, the present invention will not naturally be restricted by the following examples, and it will be possible to carry out the examples by suitably changing them within a range which is compatible with the scopes described above and later, but all of them will be involved in the technical scope of the present invention.

EXAMPLE 1

A bar having a diameter of 10 mm was produced using a titanium alloy having a chemical composition shown in Table 1. The production of the bar was conducted by the following steps. First, an ingot, which was molten in a plasma, was forged at a temperature falling in a β region and then was forged at a temperature falling in an α+β region to produce a bar having a diameter of 10 mm. The bar was then annealed at 700° C. for 30 minutes. Using the resultant bar as a test piece, a flaw resistance test and a drill machining test were carried out to evaluate its flaw resistance and the machinability. In the flaw resistance test, a surface of the test piece was buffed and the buffed surface was made flawed by using a diamond indenter at a loading of 50 to 200 g and at a rate of 75 mm/min. On the other hand, a Ti-3Al-2.5V type alloy (hereinafter, referred to as a conventional alloy) was made flawed in the same manner . Then, the comparison was made on the depth of the formed flaws between the test piece of the present invention and the conventional alloy. In the drill machining test, the test piece and the conventional alloy were respectively drilled to form holes having a diameter of 1 mm and a depth of 8 mm. The drill machining test was continued until the drill was damaged beyond use, and the number of holes formed was compared between the test piece and the conventional alloy.

The results of the flaw resistance test and the drill machining test are shown in Table 1. The flaw resistance is indicated by the ratio of depth (i.e., a depth of the conventional alloy/a depth of the test piece of the present invention). The machinability is indicated by the ratio of the number of holes formed in drilling (the number of holes formed in the test piece of the present invention/the number of holes formed in the conventional alloy).

TABLE 1

| | Chemical composition (mass %) | | Properties | | Problem in corrosion resistance and | |
|---|---|---|---|---|---|---|
| No. | O | Fe | Flaw resistance | Machin-ability | forgeability | Remarks |
| 1 | 0.18 | 0.30 | 0.6 | 1.2 | — | Comparative Examples |
| 2 | 0.35 | 0.18 | 1.1 | 0.8 | — | |
| 3 | 0.65 | 0.40 | 1.4 | 0.5 | — | |
| 4 | 0.35 | 0.95 | 1.2 | 1.2 | poor corrosion resistance | |
| 5 | 0.20 | 0.20 | 1.1 | 1.1 | — | Present Examples |
| 6 | 0.25 | 0.30 | 1.1 | 1.2 | — | |
| 7 | 0.30 | 0.25 | 1.1 | 1.2 | — | |
| 8 | 0.30 | 0.30 | 1.15 | 1.2 | — | |
| 9 | 0.35 | 0.40 | 1.2 | 1.3 | — | |
| 10 | 0.35 | 0.60 | 1.2 | 1.2 | — | |
| 11 | 0.40 | 0.40 | 1.2 | 1.2 | — | |
| 12 | 0.40 | 0.60 | 1.2 | 1.2 | — | |
| 13 | 0.50 | 0.50 | 1.3 | 1.1 | — | |
| 14 | 0.55 | 0.70 | 1.3 | 1.1 | — | |
| 15 | 0.60 | 0.80 | 1.4 | 1.1 | — | |

The following considerations can be derived from the results shown in Table 1. The sample No. 1 corresponds to a comparative example in which the content of oxygen is too low. As seen from the sample No. 1, the too low content of oxygen results in the deterioration of flaw resistance as compared with the conventional alloy. The sample No. 2 corresponds to a comparative example in which the content of iron is too low. As seen from the sample No. 2, the too low content of iron results in the deterioration of machinability. The sample No. 3 corresponds to a comparative example in which the content of oxygen is excessive. As seen from the sample No. 3, the excessive content of oxygen results in the deterioration of machinability. The sample No. 4 corresponds to a comparative example in which the content of iron is excessive. As seen from the sample No. 4, the excessive content of iron results in the deterioration of corrosion resistance.

Contrary to this, the samples Nos. 5 to 15 correspond to the examples of the present invention which satisfy the chemical composition defined in the present invention. As seen from the samples Nos. 5 to 15, both the flaw resistance and the machinability are improved as compared with the conventional alloy.

EXAMPLE 2

A bar having a diameter of 10 mm was produced from a titanium alloy having a chemical composition show n in Table 2 in the same manner as that employed in Example 1. Using the resultant bar as a test piece, a flaw resistance test and a drill machining test were carried out in the same manner as that conducted in Example 1 to evaluate its flaw resistance and the machinability. The results of the flaw resistance test and the drill machining test are shown in Table 2. In the flaw test, the target flaw resistance of the titanium alloy of the present invention was defined to a value 1.5 times as large as that of the conventional alloy. In the drill machining test, the target machinability was defined to a value equivalent to that of the conventional alloy or more.

TABLE 2

| | Chemical composition (mass %) | | | Properties | | Problem in corrosion resistance and | |
|---|---|---|---|---|---|---|---|
| No. | O | Fe | Si | Flaw resistance | Machin-ability | forgeability | Remarks |
| 1 | 0.12 | 0.5 | 0.5 | 0.9 | 1.2 | — | Comparative Examples |
| 2 | 0.25 | 0.1 | 0.5 | 1.5 | 0.8 | — | |
| 3 | 0.70 | 0.5 | 0.6 | 1.8 | 0.4 | — | |
| 4 | 0.30 | 0.5 | 1.2 | 1.6 | 1.1 | poor forgeability | |
| 5 | 0.30 | 1.2 | 0.6 | 1.6 | 1.2 | poor corrosion resistance | |
| 6 | 0.30 | 0.5 | 0.1 | 1.1 | 1.1 | — | |
| 7 | 0.15 | 0.2 | 0.2 | 1.5 | 1.3 | — | Present Examples |
| 8 | 0.20 | 0.3 | 0.3 | 1.5 | 1.3 | — | |
| 9 | 0.20 | 0.3 | 0.4 | 1.6 | 1.3 | — | |
| 10 | 0.30 | 0.6 | 0.8 | 1.6 | 1.3 | — | |
| 11 | 0.30 | 0.3 | 0.8 | 1.6 | 1.2 | — | |
| 12 | 0.30 | 0.6 | 0.3 | 1.5 | 1.2 | — | |
| 13 | 0.35 | 0.3 | 0.3 | 1.5 | 1.2 | — | |
| 14 | 0.35 | 0.3 | 0.8 | 1.6 | 1.2 | — | |
| 15 | 0.40 | 0.3 | 0.8 | 1.6 | 1.2 | — | |
| 16 | 0.40 | 0.6 | 0.8 | 1.7 | 1.2 | — | |
| 17 | 0.40 | 0.7 | 0.8 | 1.75 | 1.2 | — | |
| 18 | 0.45 | 0.3 | 0.3 | 1.7 | 1.1 | — | |
| 19 | 0.55 | 0.9 | 0.9 | 1.8 | 1.1 | — | |
| 20 | 0.60 | 1.0 | 1.0 | 1.8 | 1.05 | — | |

The following considerations can be derived from the results shown in Table 2. The sample No. 1 corresponds to a comparative example in which the content of oxygen is too low. As seen from the sample No. 1, the too low content of oxygen results in the deterioration of flaw resistance as compared with the conventional alloy. The sample No. 2 corresponds to a comparative example in which the content of iron is too low. As seen from the sample No. 2, the too low content of iron results in the deterioration of machinability. The sample No. 3 corresponds to a comparative example in which the content of oxygen is excessive. As seen from the sample No. 3, the excessive content of oxygen results in the deterioration of machinability. The sample No. 4 corresponds to a comparative example in which the content of silicon is excessive. As seen from the sample No. 4, the excessive content of silicon results in the deterioration of forgeability. The sample No. 5 is a comparative example in which the content of iron is excessive. As seen from the sample No. 5, the excessive content of iron results in the deterioration of corrosion resistance. The sample No. 6 corresponds to a comparative example in which the content of silicon is too low. As seen from the sample No. 6, the too low content of silicon results in the deterioration of flaw resistance and machinability.

Contrary to this, the samples Nos. 7 to 20 correspond to the examples of the present invention which satisfy the chemical composition defined in the present invention. As seen from the samples Nos. 7 to 20, both the flaw resistance and machinability are improved as compared with the conventional alloy.

EXAMPLE 3

A test piece having a diameter of 20 mm was produced from a titanium alloy including oxygen of 0.37 mass percent, iron of 0.37 mass percent, with the balance including titanium and inevitable impurities. The production of the test sample was conducted by the following steps. First, an ingot, which was molten in a plasma, was forged at a temperature falling in a β region and then was forged at a temperature falling in an α+β region to produce a bar having a diameter of 20 mm. The bar was then subjected to machining to form a test piece having a diameter of 20 mm and a length of 30 mm. Under the conditions shown in Table 3, the test piece was induction heated, and then was press-molded (i.e., hot forged) to a height of 10 mm. After that, the test piece was cooled.

The Vickers hardness (Hv) of test piece was measured along its cross-section using a Vickers hardness tester. The hardness at the portion from the surface to the depth of 0.5 mm (hereinafter, referred to as a surface) was compared with that at the portion from the depth of 0.5 mm and below (hereinafter, referred to as an inside), and the increase in hardness from the surface toward the inside was evaluated. The results of the hardness test are shown in Table 3 together with the cooling conditions. In Example 3, a β-transformation temperature of the titanium alloy was 950° C.

TABLE 3

| | Forging conditions | | | | Cooling conditions | | | |
|---|---|---|---|---|---|---|---|---|
| No. | Material temp. (°C.) | Mold Temp. (°C.) | Strain rate ($sec^{-1}$) | Surface cracking | Time before start cooling (sec) | Cooling rate (°C./min) | Final temp. (°C.) | Increase in hardness (Hv) |
| 1 | 650 | 600 | $10^{-1}$ | Yes | — | — | — | — |
| 2 | 900 | 300 | $10^{-2}$ | No | 5 | 500 | 300 | 5 |
| 3 | 900 | 600 | $10^{-2}$ | No | 5 | 500 | 150 | 5 |
| 4 | 900 | 600 | $10^{-1}$ | No | 15 | 500 | 300 | 5 |
| 5 | 900 | 600 | $10^{-1}$ | No | 5 | 50 | 300 | 5 |
| 6 | 900 | 600 | $10^{-1}$ | No | 5 | 500 | 700 | 0 |
| 7 | 750 | 150 | $10^{0}$ | No | 5 | 500 | 50 | 25 |
| 8 | 950 | 150 | $10^{0}$ | No | 5 | 500 | 50 | 40 |
| 9 | 1000 | 150 | $10^{0}$ | No | 5 | 500 | 50 | 40 |
| 10 | 1050 | 150 | $10^{0}$ | No | 5 | 500 | 50 | 40 |
| 11 | 900 | 150 | $10^{-1}$ | No | 12 | 500 | 300 | 30 |
| 12 | 900 | 150 | $10^{-1}$ | No | 5 | 500 | 300 | 40 |
| 13 | 900 | 300 | $10^{-1}$ | No | 5 | 500 | 300 | 35 |
| 14 | 900 | 500 | $10^{-1}$ | No | 5 | 500 | 300 | 25 |
| 15 | 850 | 600 | $10^{0}$ | No | 4 | 1000 | 50 | 35 |
| 16 | 800 | 600 | $10^{-1}$ | No | 3 | 1000 | 50 | 25 |
| 17 | 800 | 600 | $10^{-1}$ | No | 10 | 100 | 500 | 20 |

The following considerations can be derived from the results shown in Table 3. The sample No. 1 was made cracked when press-molded because the heating temperature was too low. In the sample No. 2, the hardness at its surface is not sufficiently higher than at its inside due to the too low strain rate during the press-molding, in spite that the mold had sufficiently low temperature. In the sample No. 3, the hardness at its surface is not sufficiently higher than at its inside due to the low strain rate during the press-molding and too high temperature of the mold. In the sample No. 4, the hardness at its surface is not sufficiently higher than at its inside due to the elapse of too long time until the cooling was started after the forging. In the sample No. 5, the hardness at its surface is not sufficiently higher than at its inside due to the low cooling rate in the cooling conducted after the forging. In the sample No. 6, the hardness at its surface is equal to at its inside because the cooling was stopped in the state where the titanium alloy was still at high temperature.

Contrary to this, the samples Nos. 7 to 17, produced under the production conditions defined in the present invention, have Hv20 or more at its surface than at its inside. However, the sample No. 9 has an oxidized layer with large thickness formed on its surface because the titanium alloy was heated at a temperature exceeding the preferable maximum value (950° C.).

EXAMPLE 4

A test piece having a diameter of 20 mm and a length of 30 mm was produced from a titanium alloy including oxygen of 0.30 mass percent, iron of 0.50 mass percent, and silicon of 0.70 mass percent, with the balance including titanium and inevitable impurities. The production of the test piece was conducted in the same manner as that employed in Example 3. Under the conditions shown in Table 4, the test piece was induction heated, and then was press-molded (i.e., hot forged) to a height of 10 mm. After that, the test piece was cooled. The hardness (Hv) of test piece was measured along its cross-section using a Vickers hardness tester. The hardness at the portion from the surface to the depth of 0.5 mm (hereinafter, referred to as a surface) was compared with that at the portion from the depth of 0.5 mm and below (hereinafter, referred to as an inside), and the increase in hardness from the surface toward the inside was evaluated. The results of the hardness test are shown in Table 4 together with the cooling conditions. In Example 4, a β-transformation temperature of the titanium alloy was 935° C.

TABLE 4

| | Forging conditions | | | | Cooling conditions | | | |
|---|---|---|---|---|---|---|---|---|
| No. | Material temp. (°C.) | Mold temp. (°C.) | Strain rate ($sec^{-1}$) | Surface cracking | Time before start cooling (sec) | Cooling rate (°C./min) | Final temp. (°C.) | Increase in hardness (Hv) |
| 1 | 650 | 600 | $10^{-1}$ | Yes | — | — | — | — |
| 2 | 900 | 300 | $10^{-2}$ | No | 5 | 500 | 300 | 10 |
| 3 | 900 | 600 | $10^{-2}$ | No | 5 | 500 | 150 | 5 |
| 4 | 900 | 600 | $10^{-1}$ | No | 15 | 500 | 300 | 5 |
| 5 | 900 | 600 | $10^{-1}$ | No | 5 | 50 | 300 | 10 |
| 6 | 900 | 600 | $10^{-1}$ | No | 5 | 500 | 700 | 0 |
| 7 | 735 | 150 | $10^{0}$ | No | 5 | 500 | 50 | 35 |
| 8 | 950 | 150 | $10^{0}$ | No | 5 | 500 | 50 | 45 |
| 9 | 1000 | 150 | $10^{0}$ | No | 5 | 500 | 50 | 45 |
| 10 | 1050 | 150 | $10^{0}$ | No | 5 | 500 | 50 | 45 |
| 11 | 900 | 150 | $10^{-1}$ | No | 12 | 500 | 300 | 35 |
| 12 | 900 | 150 | $10^{-1}$ | No | 5 | 500 | 300 | 45 |
| 13 | 900 | 300 | $10^{-1}$ | No | 5 | 500 | 300 | 35 |
| 14 | 900 | 500 | $10^{-1}$ | No | 5 | 500 | 300 | 30 |
| 15 | 850 | 600 | $10^{0}$ | No | 4 | 1000 | 50 | 40 |
| 16 | 800 | 600 | $10^{-1}$ | No | 3 | 1000 | 50 | 30 |
| 17 | 800 | 600 | $10^{-1}$ | No | 10 | 100 | 500 | 25 |

The following considerations can be derived form the results shown in Table 4. The sample No. 1 was made cracked when press-molded because the heating temperature was too low. In the sample No. 2, the hardness at its surface is not sufficiently higher than at its inside due to the too low strain rate during the press-molding, in spite that the mold had sufficiently low temperature. In the sample No. 3, the hardness at its surface is not sufficiently higher than at its surface due to the low strain rate during the press-molding and too high temperature of the mold. In the sample No. 4, the hardness at its surface is not sufficiently larger than at its inside due to the elapse of too long time until the cooling is started after the forging. In the sample No. 5, the hardness at its surface is not sufficiently higher than at its inside due to the low cooling rate in the cooling conducted after the forging. In the sample No. 6, the hardness at its inside is equal to at its inside because the cooling was stopped in the state where the titanium alloy was still at high temperature.

Contrary to this, the samples Nos. 7 to 17, produced under the production conditions defined in the present invention, have Hv20 or more at its surface than at its inside. However, the sample No. 9 has an oxidized layer with large thickness formed on its surface because the titanium alloy was heated at a temperature exceeding the preferable maximum value (950° C.).

EXAMPLE 5

A round bar having a diameter of 20 mm was produced using a titanium alloy having a chemical composition shown in Table 5. The production of the round bar was conducted by the following step. First, an ingot was molten in a plasma, and then, was subjected to processing such as rolling to produce the round bar. The obtained round bar was cut into a length of 25 mm. On the other hand, a mold for watch body was set to a hot forging device and was heated to 150° to 250° C. Meanwhile, the round bar was induction heated to a predetermined temperature shown in Table 5, and then, was left for 5 to 10 seconds. Subsequently, the round bar was placed on the mold having a temperature of 150° to 250° C. and was subjected to a primary forging. The primary forging was conducted using a friction press of 200 tons in weight.

The primary forged product was subjected to chemical polishing to remove a scale formed at its surface. Then, the product was induction heated to a predetermined temperature shown in Table 5, and then, was left for 5 to 10 seconds. Subsequently, the product was subjected to a secondary forging. In the secondary forging, a finishing mold for watch body was set to a forging device of 80 tons in weight, and was heated to 150° to 250° C. as was the case of the primary forging. The strain rate in the secondary forging is as shown in Table 5. After the forging, the product was cooled under the conditions shown in Table 5.

The resultant product was subjected to trimming (using a press), barrel processing (to remove a flash and a scale), a chemical polishing (to completely remove a scale), so as to obtain a secondary forged product. The inner side of the back surface (i.e. the surface which will face the module accommodated in the watch) and the frame of the front surface (i.e., the surface onto which a dial plate is placed: dial open) were then subjected to cutting by a numerical control cutting machine. At the same time, the product was subjected to a primary machining in which a drilling was conducted to form spring loaded pin holes for use in the attachment of band and to form a winding stem hole for use in the placement of winding stem. After the drilling, the secondary forged product was subjected to a secondary machining in which the surface thereof was polished by a grinding stone or an airplane cloth. As a result, a watch body was obtained.

The obtained watch body was subjected to tests for evaluating the difference in hardness between at its surface and at its inside, the resistance to flaw, the drill machinability, and the mirror-surface properties in comparison with a Ti-3Al-2.5V type alloy, which is a conventional titanium alloy. The results of the tests are shown in Table 5.

The hardness was measured using a flickers hardness tester at a load of 100 g. In the evaluation of flaw resistance, the surfaces of the test piece was buffed using a diamond indenter to form flaws on its surface at a loading of 200 g and at a rate of 75 mm/min. On the other hand, the conventional alloy was made flawed in the same manner. Then, the comparison was made on the width of the formed flaws between the test piece of the present invention and the conventional alloy, and the flaw resistance is indicated by the ratio of width therebetween (a width of flaws formed in the conventional alloy/a width of flaws formed in the test piece). In the drill machining test, the test piece and the conventional ally were continuously drilled to form holes having a diameter of 1.5 mm at a rolling rate of 2000 RPM using an SKH-9 type drill (JIS G 4403), and the drill machining test was conducted in the same manner as that employed in Example 1. In the mirror-surface test, the mirror-surface properties were visually evaluated based on a standard sample in terms of the ability of allowing the formation of a flat surface free from pits, flaws, deformation and the like.

TABLE 5

| | | | Forging conditions (secondary forging) | | | Cooling conditions | | | Properties | | | | |
|---|---|---|---|---|---|---|---|---|---|---|---|---|---|
| | No | Chemical composition (mass %) | Material temp. (° C.) | Mold. temp. (° C.) | Strain rate ($sec^{-1}$) | Time before start cooling (sec) | Cooling rate (° C./min) | Final temp. (° C.) | Increase in hardness (Hv) | Flaw resistance | Drill machinability | Mirror-surface properties | Remarks |
| Present Examples | 1 | O:0.30, Fe:0.30 | 900 | 200 | 1 | 3 | 500 | 100 | 25 | 1.2 | 1.3 | Very good | — |
| | 2 | O:0.40, Fe:0.40 | 900 | 200 | 1 | 3 | 500 | 100 | 30 | 1.3 | 1.2 | Very good | — |
| | 3 | O:0.45, Fe:0.45 | 900 | 200 | 1 | 3 | 500 | 150 | 35 | 1.4 | 1.2 | Very good | — |
| | 4 | O:0.40, Fe:0.40 | 900 | 200 | 0.01 | 3 | 500 | 100 | 5 | 1.2 | 1.2 | Good | — |
| | 5 | O:0.40, Fe:0.40 | 900 | 200 | 1 | 3 | 50 | 100 | 5 | 1.2 | 1.2 | Good | — |
| Comparative Examples | 6 | O:0.65, Fe:0.55 | 900 | 200 | 1 | 3 | 500 | 100 | 35 | 1.5 | 0.5 | Good | — |
| | 7 | O:0.18, Fe:0.17 (*1) | 850 | 200 | 1 | 3 | 500 | 100 | 5 | 0.6 | 1.2 | Many pinholes | — |
| | 8 | Al:3.2, V:2.1., O:0.15 (α + β type) | 900 | 200 | 1 | 3 | 500 | 100 | −5 | 1 | 1 | Good | — |
| | 9 | Al:4.5, V:3, Fe:2, Mo:2 (Near β-type) | 850 | 200 | 1 | 3 | 500 | 100 | 0 | 1.8 | 0.4 | Good | solution treatment & aging after forging |

Remarks: *1: industrial pure titanium (JIS-2)

The following considerations can be derived from the results shown in Table 5. The samples Nos. 1 to 3 correspond to the examples where the processing method of the present invention was employed for the titanium alloy of the present invention. All the samples Nos. 1 to 3 had the hardness larger at its surface than at its inside with excellent properties. The samples Nos. 4 and 5 correspond to examples where the processing method other than that of the present invention was employed for the titanium alloy of the present invention. Although the hardness of the samples Nos. 4 and 5 respectively was not larger at its surface than at its inside, the properties thereof were excellent next to the samples Nos. 1 to 3.

Contrary to this, the samples Nos. 6 to 9, corresponding to the comparative examples, had problems (a) to (d) described below:

(a) the sample No. 6 had too large content of oxygen, resulting in the deterioration of drill machinability;

(b) the sample No. 7 had too small content of oxygen, resulting in the deterioration of flaw resistance and mirror surface properties;

(c) the sample No. 8 was a Ti-3Al-2.5V type alloy used as a standard; and (d) the sample No. 9 was a Nearβ alloy which contained a large amount of alloy elements and was able to be hardened by thermal treatment (i.e., solution treatment+aging). The sample No. 9 was excellent in flaw resistance, but was poor in drill machinability.

The watch body produced by the method of the present invention using the material of the present invention was superior to that produced in accordance with the conventional art in the combination of machinability and flaw resistance, and the beauty.

According to the example of the present invention, a watch body was produced using a titanium alloy material containing iron of 0.20 to 0.8 mass percent, oxygen of 0.20 to 0.6 mass percent, with the balance substantially including titanium. In the production of the watch body, the titanium alloy used as a material was heated, and then, the heated material was placed to a mold for watch body where the material was hot forged into a predetermined shape. Then, the resultant was subjected to machining such as barrel processing and cutting, and finishing such as polishing. As a result, a watch body was obtained. Thus-obtained watch body was formed with a surface having a hardness larger than that of those made of conventional materials, and therefore, its surface was hard to be flawed or concaved. In addition, the watch body had a clear mirror-finished surface which had been unable to attain in the conventional art, and also was light in weight with beauty and elegance.

EXAMPLE 6

A round bar having a diameter of 20 mm was produced using a titanium alloy having a chemical composition shown in Table 6 in the same manner as that employed in Example 5. Then, the obtained round bar was cut into a length of 25 mm.

After that, the a mold for watch body was set to a hot forging device and was heated to 150° to 250° C. Meanwhile, the round bar was induction heated to a predetermined temperature shown in Table 6, and then, was left for 5 to 10 seconds. Subsequently, the round bar was placed on the mold having a temperature of 150° to 250° C. and was subjected to a primary forging. The primary forging was conducted using a friction press of 200 tons in weight.

The primary forged product was subjected to chemical polishing to remove a scale formed on its surface. Then, the product was induction heated to a predetermined temperature shown in Table 6, and then, was left for 5 to 10 seconds. Subsequently, the product was subjected to a secondary forging. In the secondary forging, a finishing mold for watch body was set to a forging device of 80 tons in weight, and was heated to 150° to 250° C. as was the case of the primary forging. The strain rate in the secondary forging is as shown in Table 6. After the forging, the product was cooled under the conditions shown in Table 6.

The resultant product was subjected to trimming (using a press), barrel processing (to remove a flash and a scale), a chemical polishing (to completely remove a scale), so as to obtain a secondary forged product. The inner side of the back surface (i.e. the surface which w ill face the module accommodated in the watch) and the frame of the front surface (i.e., the surface onto which a dial plate is placed: dial open) were then subjected to cutting by a numerical control cutting machine. At the same time, the product was subjected to a primary machining in which a drilling was conducted to form spring loaded pin holes for use in the attachment of band and to form a winding stem hole for use in the placement of winding stem. After the drilling, the secondary forged product was subjected to a secondary machining in which the surface thereof was polished using a grinding stone or an airplane cloth. As a result, a watch body was obtained.

The obtained watch body was subjected to tests for evaluating the difference in hardness between at its surface and at its inside, the resistance to flaw, the drill machinability, and the mirror-surface properties in comparison with a Ti-3Al-2.5V type alloy, which is a conventional titanium alloy. The results of the tests are shown in Table 6.

The evaluation on the hardness, flaw resistance, drill machinability and mirror-surface properties was conducted in the same manner as that employed in Example 5.

invention was employed for the titanium alloy of the present invention. Although the hardness of the samples Nos. 4 and 5 respectively was not larger at its surface than at its inside, the properties thereof were excellent next to the samples Nos. 1 to 3.

Contrary to this, the samples Nos. 6 to 10, corresponding to the comparative examples, had problems (a) to (e) described below:

(a) the sample No. 6 had too large content of oxygen, resulting in the deterioration of drill machinability;

(b) the sample No. 7 had too small content of silicon, resulting in the deterioration of flaw resistance and mirror-surface properties;

(c) the sample No. 8 had too small content of oxygen, resulting in the deterioration of flaw resistance and mirror-surface properties (d) the sample No. 9 was a Ti-3Al-2.5V type alloy used as a standard; and (e) the sample No. 10 was a Nearβ alloy which contained a large amount of alloy elements and was able to be hardened by thermal treatment (i.e., solution treatment+aging). The sample No. 10 was excellent in flaw resistance, but was poor in drill machinability.

The watch body produced by the method of the present invention using the material of the present invention was superior to that produced in accordance with the conventional art in the combination of machinability and flaw resistance, and the beauty.

According to the example of the present invention, a watch body was produced using a titanium alloy material containing iron of 0.2 to 1.0 mass percent, oxygen of 0.15 to 0.60 mass percent, and silicon of 0.2 to 1.0 mass percent

TABLE 6

| | | | Forging conditions (secondary forging) | | | Cooling conditions | | | Properties | | | | |
|---|---|---|---|---|---|---|---|---|---|---|---|---|---|
| | No | Chemical composition (mass %) | Material temp. (° C.) | Mold. temp. (° C.) | Strain rate ($sec^{-1}$) | Time before start cooling (sec) | Cooling rate (° C./min) | Final temp. (° C.) | Increase in hardness (Hv) | Flaw resistance | Drill machinability | Mirror-surface properties | Remarks |
| Present Examples | 1 | O:0.25, Fe:0.4, Si: 0.4 | 900 | 200 | 1 | 3 | 500 | 100 | 30 | 1.6 | 1.2 | Very good | — |
| | 2 | O:0.3, Fe:0.5, Si:0.6 | 900 | 200 | 1 | 3 | 500 | 100 | 35 | 1.7 | 1.2 | Very good | — |
| | 3 | O:0.4, Fe:0.6, Si:0.7 | 900 | 200 | 1 | 3 | 500 | 150 | 40 | 1.8 | 1.1 | Very good | — |
| | 4 | O:0.3, Fe:0.5, Si:0.6 | 900 | 200 | 0.01 | 3 | 500 | 100 | 10 | 1.5 | 1.2 | Good | — |
| | 5 | O:0.3, Fe:0.5, Si:0.6 | 900 | 200 | 1 | 3 | 50 | 100 | 10 | 1.5 | 1.2 | Good | |
| Comparative Examples | 6 | O:0.65, Fe:0.5, Si:0.6 | 900 | 200 | 1 | 3 | 500 | 100 | 35 | 1.9 | 0.5 | Good | — |
| | 7 | O:0.3, Fe:0.5, Si:0.1 | 850 | 200 | 1 | 3 | 500 | 100 | 30 | 1.3 | 1.2 | Good | — |
| | 8 | O:0.18, Fe:0.17 (*1) | 850 | 200 | 1 | 3 | 500 | 100 | 5 | 0.6 | 1.2 | Poor | — — |
| | 9 | Al:3.2, V:2.1, O:0.15 (α + β type) | 900 | 200 | 1 | 3 | 500 | 100 | −5 | 1 | 1 | Good | — — |
| | 10 | Al:4.5, V:3, Fe:2, Mo:2 (Near β type) | 850 | 200 | 1 | 3 | 500 | 100 | 0 | 1.8 | 0.4 | Good | solution treatment & aging after forging |

Remarks: *1: industrial pure titanium (JIS-2)

The following considerations can be derived from the results shown in Table 6. The samples Nos. 1 to 3 correspond to the examples where the processing method of the present invention was employed for the titanium alloy of the present invention. All the samples Nos. 1 to 3 had the hardness larger at its surface than at its inside with excellent properties. The samples Nos. 4 and 5 correspond to examples where the processing method other than that of the present with the balance substantially including titanium. In the production of the watch body, the titanium alloy used as a material was heated, and then, the heated material was placed to a mold for watch body where the material was hot forged into a predetermined shape. Then, the resultant was subjected to machining such as barrel processing and cutting, and finishing such as polishing. As a result, a watch body was obtained. Thus-obtained watch body was formed with a surface having a hardness larger than that of those made of conventional materials, and therefore, its surface was hard to be flawed or concaved. In addition, the watch body had a clear mirror-finished surface which had been unable to attain in the conventional art, and also was light in weight with beauty and elegance.

EXAMPLE 7

A round bar having a diameter of 6.5 mm was produced using a titanium alloy having a chemical composition shown in Table 7. The production of the round bar was conducted by the following step. First, an ingot was molten in a plasma, and then, was subjected to processing such as rolling to produce the round bar. The obtained round bar was cut into a length of 47 mm.

On the other hand, a mold for watch band (in this case, a mold for two-piece unit) was set to a hot forging device and was heated to 150° to 250° C. Meanwhile, the round bar was induction heated to a predetermined temperature shown in Table 7, and then, was left for 5 to 10 seconds. Subsequently, the round bar was placed on the mold having a temperature of 150° to 250° C. and was subjected to a primary forging. The primary forging was conducted using a friction press of 120 tons in weight.

The hardness was measured using a Vickers hardness tester at a load of 100 g. In the flaw resistance test, the surface of the test pieces were buffed using a diamond indenter to form flaws on their surface at a loading of 200 g and at a rate of 75 mm/min. On the other hand, the conventional alloy was made flawed in the same manner. Then, the comparison was made on the width of the formed flaws between the test pieces of the present invention and the conventional alloy. The evaluation of flaw resistance was conducted in the same manner as that employed in Example 5. In the drill machining test, the test pieces and the conventional ally were continuously drilled to form holes having a diameter of 1.0 mm at a rolling rate of 4000 RPM using an SKH-9 type drill (JIS G 4403). The drill machining test was conducted in the same manner as that employed in Example 1. In the hair-line properties test, the hair-lines were visually observed to evaluate the hair-line properties in comparison with the standard sample in terms of the ability of allowing the formation of hair-lines which were not disturbed, broken, or bad-shaped without impairing a uniform luster on the surface.

TABLE 7

| | | | Forging conditions | | | Cooling conditions | | | Properties | | | | |
|---|---|---|---|---|---|---|---|---|---|---|---|---|---|
| | No | Chemical composition (mass %) | Material temp. (° C.) | Mold temp. (° C.) | Strain rate ($sec^{-1}$) | Time before start cooling (sec) | Cooling rate (° C./min) | Final temp. (° C.) | Increase in hardness (Hv) | Flaw resistance | Drill machin-ability | Hair-line properties | Remarks |
| Present Examples | 1 | O:0.30, Fe:0.30 | 900 | 200 | 1 | 2 | 800 | 50 | 35 | 1.3 | 1.2 | Very good | — |
| | 2 | O:0.40, Fe:0.40 | 900 | 200 | 1 | 2 | 800 | 50 | 40 | 1.4 | 1.1 | Very good | — |
| | 3 | O:0.45, Fe:0.45 | 900 | 200 | 1 | 2 | 800 | 100 | 45 | 1.4 | 1.1 | Very good | — |
| | 4 | O:0.40, Fe:0.40 | 900 | 200 | 0.01 | 2 | 800 | 50 | 10 | 1.2 | 1.1 | Good | — |
| | 5 | O:0.40, Fe:O.40 | 900 | 200 | 1 | 2 | 50 | 50 | 10 | 1.2 | 1.1 | Good | — |
| Comparative Examples | 6 | O:0.65, Fe:0.65 | 850 | 200 | 1 | 2 | 800 | 50 | 40 | 1.5 | 0.5 | Good | — |
| | 7 | O:0.18, Fe:0.17 (*1) | 850 | 200 | 1 | 2 | 800 | 50 | 10 | 0.7 | 1.2 | Poor | — |
| | 8 | Al:3.2, V:2.1, O:0.15 (α + β-type) | 900 | 200 | 1 | 2 | 800 | 50 | −5 | 1 | 1 | Good | — |
| | 9 | Al:4.5, V:3, Fe:2, Mo:2 (Near β-type) | 850 | 200 | 1 | 2 | 800 | 50 | 0 | 1.8 | 0.4 | Good | solution treatment & aging after forging |

Remarks: #1 : industrial pure titanium (JIS-2)

The primary forged product was subjected to chemical polishing to remove a scale formed on its surface. The resultant was subjected to trimming (in which trimming and breaking of the two-piece unit into independent links are conducted simultaneously using a press), barrel processing (to remove a flash and a scale), a chemical polishing (to completely remove a scale), so as to obtain a secondary forged links. After that, a primary machining was conducted to the respective links to form a hole for use in connecting the links with each other into one watch band by inserting a pin in the hole.

The obtained links, used as test pieces, were subjected to tests for evaluating the difference in hardness between at their surface and at their inside, the resistance to flaw, the drill machinability, and the hair-line properties in comparison with a Ti-3Al-2.5V type alloy, which is a conventional titanium alloy. The results of the tests are shown in Table 7.

The following considerations can be derived from the results shown in Table 7. The samples Nos. 1 to 3 correspond to the examples where the processing method of the present invention was employed for the titanium alloy of the present invention. All the samples Nos. 1 to 3 had the hardness larger at their surface than at their inside with excellent properties. The samples Nos. 4 and 5 correspond to examples where the processing method other than that of the present invention was employed for the titanium alloy of the present invention. Although the hardness of the samples Nos. 4 and 5 was not larger at their surface than at their inside, the properties thereof were excellent next to the samples Nos. 1 to 3.

Contrary to this, the samples Nos. 6 to 9, corresponding to the comparative examples, had problems (a) to (d) described below:

(a) the sample No. 6 had too large content of oxygen, resulting in the deterioration of drill machinability;

(b) the sample No. 7 had too small content of iron, resulting in the deterioration of flaw resistance and hair-line properties;

(c) the sample No. 8 was a Ti-3Al-2.5V type alloy used as a standard; and (d) the sample No. 9 was a Nearβ alloy which contained a large amount of alloy elements and was be able to be hardened by thermal treatment (i.e., solution treatment+aging). The sample No. 9 was excellent in flaw resistance, but was poor in drill machinability.

The watch band produced by the method of the present invention using the material of the present invention was superior to that produced in accordance with the conventional art in the combination of machinability and flaw resistance, and the beauty.

According to the example of the present invention, a watch belt was produced using a titanium alloy material containing iron of 0.20 to 0.8 mass percent, oxygen of 0.20 to 0.6 mass percent, with the balance substantially including titanium. In the production of the watch band, the titanium alloy used as a material was heated, and then, the heated material was placed to a mold for watch belt where the material was hot forged into a predetermined shape. Then, the resultant was subjected to machining such as barrel processing and drilling, and finishing such as polishing. As a result, belt pieces were obtained. The belt pieces were connected to each other into one watch belt by inserting a pin through the holes formed in each piece. Thus-obtained watch belt was formed with a surface having a hardness larger than that of those made of conventional materials, and therefore, its surface was hard to be flawed or concaved. In addition, the watch band was excellent in hair-line properties, whereby minute hair-lines were able to be formed on its surface, which had been unable to attain in the conventional art. The watch band also was light in weight with beauty and elegance.

in Table 8. The production of the round bar was conducted by the following step. First, an ingot was molten in a plasma, and then, was subjected to processing such as rolling to produce the round bar. The obtained round bar was cut into a length of 47 mm.

On the other hand, a mold for watch band (in this case, a mold for two-piece unit) was set to a hot forging device and was heated to 150° to 250° C. Meanwhile, the round bar was induction heated to a predetermined temperature shown in Table 7, and then, was left for 5 to 10 seconds. Subsequently, the round bar was placed on the mold having a temperature of 150° to 250° C. and was subjected to a primary forging. The primary forging was conducted using a friction press of 120 tons in weight.

The primary forged product was subjected to chemical polishing to remove a scale formed on its surface. The resultant was subjected to trimming (in which trimming and breaking of the two-piece unit into independent links are conducted simultaneously using a press), barrel processing (to remove a flash and a scale), a chemical polishing (to completely remove a scale), so as to obtain a secondary forged links. After that, a primary machining was conducted to the respective links to form a hole for use in connecting the links with each other into one watch band by inserting a pin in the hole.

The obtained links, used as test pieces, were subjected to tests for evaluating the difference in hardness between at their surface and at their inside, the resistance to flaw, the drill machinability, and the hair-line properties in comparison with a Ti-3Al-2.5V type alloy, which is a conventional titanium alloy. The results of the tests are shown in Table 8.

The evaluation on the hardness, flaw resistance, drilling machinability, and hair-line properties was conducted in the same manner as that employed in Example 7.

TABLE 8

| | | | Forging conditions | | | Cooling conditions | | | Properties | | | | |
|---|---|---|---|---|---|---|---|---|---|---|---|---|---|
| | No | Chemical composition (mass %) | Material temp. (° C.) | Mold. temp. (° C.) | Strain rate ($sec^{-1}$) | Time before start cooling (sec) | Cooling rate (° C./min) | Final temp. (° C.) | Increase in hardness (Hv) | Flaw resistance | Drill machina ability | Hair-line properties | Remarks |
| Pres | 1 | O:0.25, Fe:0.4, Si:0.4 | 900 | 200 | 1 | 2 | 800 | 50 | 35 | 1.7 | 1.2 | Very good | — |
| ent | 2 | O:0.3, Fe:0.5, Si:0.6 | 900 | 200 | 1 | 2 | 800 | 50 | 40 | 1.8 | 1.2 | Very good | — |
| Exa | 3 | O:0.4, Fe:0.6, Si:0.7 | 900 | 200 | 1 | 2 | 800 | 100 | 45 | 1.9 | 1.1 | Very good | — |
| mpl | 4 | O:0.3, Fe:0.5, Si:0.6 | 900 | 200 | 0.01 | 2 | 800 | 50 | 10 | 1.5 | 1.1 | Good | — |
| es | 5 | O:0.3, Fe:0.5, Si:0.6 | 900 | 200 | 1 | 2 | 50 | 50 | 10 | 1.5 | 1.1 | Good | — |
| Com | 6 | O:065, Fe:0.5, Si:0.6 | 900 | 200 | 1 | 2 | 800 | 50 | 40 | 1.9 | 0.4 | Good | — |
| para | 7 | O:0.3, Fe:0.5, Si:0.1 | 850 | 200 | 1 | 2 | 800 | 50 | 35 | 1.3 | 1.1 | Good | — |
| tive | 8 | O:0.18, Fe:0.17 (*1) | 850 | 200 | 1 | 2 | 800 | 50 | 10 | 0.7 | 1.2 | Poor | — |
| Exa | | | | | | | | | | | | | — |
| mpl | 9 | Al:3.2, V:2.1, O:0.15 (α + β-type) | 900 | 200 | 1 | 2 | 800 | 50 | −5 | 1 | 1 | Good | — |
| es | | | | | | | | | | | | | — |
| | 10 | Al:4.5, V:3, Fe:2, Mo:2 (Near β-type) | 850 | 200 | 1 | 2 | 800 | 50 | 0 | 1.8 | 0.4 | Good | solution treatment & aging after forging |

Remarks: *1: industrial pure titanium (JIS-2)

EXAMPLE 8

A round bar having a diameter of 6.5 mm was produced using a titanium alloy having a chemical composition shown The following considerations can be derived from the results shown in Table 5. The samples Nos. 1 to 3 correspond to the examples where the processing method of the present invention was employed for the titanium alloy of the present invention. All the samples Nos. 1 to 3 had the hardness larger at their surface than at their inside with excellent properties. The samples Nos. 4 and 5 correspond to examples where the processing method other than that of the present invention was employed for the titanium alloy of the present invention. Although the hardness of the samples Nos. 4 and 5 was not larger at their surface than at their inside, the properties of the samples Nos. 4 and 5 were excellent next to the samples Nos. 1 to 3.

Contrary to this, the samples Nos. 6 to 10, corresponding to the comparative examples, had problems (a) to (e) described below:

(a) the sample No. 6 had too large content of oxygen, resulting in the deterioration of drill machinability;

(b) the sample No. 7 had too small content of silicon, resulting in the deterioration of flaw resistance and hair-line properties;

(c) the sample No. 8 had too small content of oxygen, resulting in the deterioration of flaw resistance and hair-line properties;

(d) the sample No. 9 was a Ti-3Al-2.5V type alloy used as a standard; and (e) the sample No. 10 was a Nearβ alloy which contained a large amount of alloy elements and was able to be hardened by thermal treatment (i.e., solution treatment+aging). The sample No. 10 was excellent in flaw resistance, but was poor in drill machinability.

The watch band produced by the method of the present invention using the material of the present invention was superior to that produced in accordance with the conventional art in the combination of machinability and flaw resistance, and the beauty.

According to the example of the present invention, a watch belt was produced using a titanium alloy material containing iron of 0.20 to 1.0 mass percent, oxygen of 0.15 to 0.6 mass percent, silicon of 0.20 to 1.0 mass percent with the balance substantially including titanium and impurities was heated. In the production of the watch band, the titanium alloy used as a material was heated, and then, the heated material was placed to a mold for watch belt where the material was hot forged into a predetermined shape. Then, the resultant was subjected to machining such as barrel processing and drilling, and finishing such as polishing. As a result, belt pieces were obtained. The belt pieces were connected to each other into a form of a watch belt by inserting a pin through the holes formed in each piece. Thus-obtained watch belt was formed with a surface having a hardness larger than that of those made of conventional materials, and therefore, its surface was hard to be flawed or concaved. In addition, the watch band was excellent in hair-line properties, whereby minute hair-lines were able to be formed on its surface, which had been unable to attain in the conventional art. The watch band also was light in weight with beauty and elegance.

In Examples 5 to 8, the cases where watch bodies or watch bands are produced have been described. However, the present invention is not limited thereto, but is applicable to ornaments such as bracelets, earrings, pendants, necklaces, eyeglass frames and the like, various decorations and articles of daily use.

EXPLOITATION IN INDUSTRY

The present invention is constituted as described above and provides a high strength titanium alloy useful as a material for products such as ornaments, products such as ornaments made of the titanium alloy, and a method for producing products using the titanium alloy as a material. The high strength titanium alloy is capable of attaining high machinability, and the product made of the titanium alloy is excellent in beauty and decorativeness while being hard to made flawed or concaved. Whereas the present invention is most effective when applied to ornaments, it is also applicable in other applications such as decorations for which beauty and decorativeness are important factors as well as the ornaments, bicycle parts, sports goods including golf goods and fishing goods, building materials, consumer electronics, and the like.

We claim:

1. A high strength titanium alloy comprising iron of 0.2 to 1.0 mass percent, oxygen of 0.15 to 0.60 mass percent and silicon of 0.20 to 1.0 mass percent, with the balance comprising titanium and inevitable impurities.

2. A high strength titanium alloy according to claim 1, comprising iron of 0.3 to 0.7 mass percent.

3. A product made of the high strength titanium alloy of claim 1.

4. A product according to claim 3, wherein the product is an ornament.

5. A product made of high strength titanium alloy according to claim 3, having Hv20 or more at its surface larger than at its inside.

6. A method for producing a product made of the high strength titanium alloy of claim 3, comprising the steps of:

hot forging a high strength titanium alloy at a temperature of (β-transformation temperature −200° C.) or higher; and cooling the hot forged titanium alloy.

7. A method according to claim 6, wherein the hot forging is performed at a temperature of 950° C. or lower.

8. A method for producing a product of claim 5, comprising the step of:

hot forging a high strength titanium alloy at a temperature of (β-transformation temperature −200° C.) and at a strain rate of $10^{-1}$/second or higher, wherein at least one of the following conditions (a) and (b) is satisfied:

(a) the hot forging is performed using a mold having a temperature of 500° C. or lower, and then, the hot forged titanium alloy is cooled; and (b) the hot forged titanium alloy is cooled to 500° C. or lower at a cooling rate of $10^2$ °C./min or higher within 10 seconds after the hot forging.

9. A method according to claim 8, wherein the hot forging is performed at a temperature of 950° C. or lower.

10. A high strength titanium alloy according to claim 1, comprising oxygen of 0.20 to 0.40 mass percent.

11. A high strength titanium alloy according to claim 1, comprising silicon of 0.40 to 0.80 mass percent.

12. A product made of high strength titanium alloy according to claim 4, having Hv20 or more at its surface larger than at its inside.

13. A method for producing a product made of the high strength titanium alloy of claim 4, comprising the steps of:

hot forging a high strength titanium alloy at a temperature of (β-transformation temperature −200° C.) or higher; and cooling the hot forged titanium alloy.

14. A method according to claim 13, wherein the hot forging is performed at a temperature of 950° C. or lower.

15. A method for producing a product of claim 12, comprising the step of:

hot forging a high strength titanium alloy at a temperature of (β-transformation temperature −200° C.) and at a strain rate of $10^{-1}$/second or higher, wherein at least one of the following conditions (a) and (b) is satisfied:

(a) the hot forging is performed using a mold having a temperature of 500° C. or lower, and then, the hot forged titanium alloy is cooled; and (b) the hot forged titanium alloy is cooled at 500° C. or lower at a cooling rate of $10^2$ °C./min or higher within 10 seconds after the hot forging.

16. A method according to claim 15, wherein the hot forging is performed at a temperature of 950° C. or lower.

* * * * *